US010362407B2

(12) United States Patent
Akino

(10) Patent No.: US 10,362,407 B2
(45) Date of Patent: Jul. 23, 2019

(54) CONDENSER MICROPHONE UNIT AND CONDENSER MICROPHONE

(71) Applicant: Hiroshi Akino, Kanagawa (JP)

(72) Inventor: Hiroshi Akino, Kanagawa (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 263 days.

(21) Appl. No.: 15/372,857

(22) Filed: Dec. 8, 2016

(65) Prior Publication Data

US 2017/0171670 A1 Jun. 15, 2017

(30) Foreign Application Priority Data

Dec. 11, 2015 (JP) ..... 2015-241702

(51) Int. Cl.

| | |
|---|---|
| ***H04R 19/04*** | (2006.01) |
| ***H04R 7/18*** | (2006.01) |
| ***H04R 7/04*** | (2006.01) |
| ***H04R 1/04*** | (2006.01) |

(52) U.S. Cl.

CPC ..... *H04R 19/04* (2013.01); *H04R 1/04* (2013.01); *H04R 7/04* (2013.01); *H04R 7/18* (2013.01)

(58) Field of Classification Search

CPC ..... H04R 1/025; H04R 19/04; H04R 7/04; H04R 7/18; H04R 1/04

See application file for complete search history.

(56) References Cited

U.S. PATENT DOCUMENTS

| | | | | |
|---|---|---|---|---|
| 2,557,835 A * | 6/1951 | Monahan | F16J 9/28 | 277/488 |
| 4,117,275 A * | 9/1978 | Miyanaga | H04R 1/222 | 381/174 |
| 7,400,739 B2 * | 7/2008 | Akino | H04R 1/08 | 381/361 |
| 7,606,385 B2 * | 10/2009 | Akino | H04R 1/083 | 381/355 |
| 7,889,882 B2 * | 2/2011 | Marshall | H04R 19/04 | 381/113 |

(Continued)

FOREIGN PATENT DOCUMENTS

JP 4926663 5/2012

*Primary Examiner* — Duc Nguyen
*Assistant Examiner* — Taunya McCarty
(74) *Attorney, Agent, or Firm* — W&C IP

(57) ABSTRACT

Provided is a condenser microphone unit that prevents eccentricity as much as possible and achieves improvement of assembly accuracy. A condenser microphone unit including a diaphragm that vibrates upon receiving a sound wave and made by a plurality of configuration components that are assembled, the condenser microphone unit includes a base member including an opening portion to which the plurality of configuration components is attached, and an adjustment member having an outer diameter corresponding to a diameter of the opening portion, and mounted to a side surface of one or more components accommodated in the opening portion, of the plurality of configuration components. The adjustment member is a frame body exhibiting an annular shape and including a notch portion notched to have a pair of end portions, and is fixed in the opening portion in a state of being mounted to the side surface of the one or more components.

8 Claims, 19 Drawing Sheets

(56) References Cited

U.S. PATENT DOCUMENTS

| | | | | |
|---|---|---|---|---|
| 8,111,856 | B2 * | 2/2012 | Shimura | H04R 19/04 381/174 |
| 8,194,908 | B2 * | 6/2012 | Akino | H04R 19/00 381/174 |
| 8,848,950 | B2 * | 9/2014 | Shimura | H04R 19/016 381/174 |
| 2006/0002576 | A1 * | 1/2006 | Akino | H04R 1/021 381/361 |
| 2012/0237072 | A1 * | 9/2012 | Akino | H04R 19/04 381/356 |
| 2013/0230195 | A1 * | 9/2013 | Akino | H04R 1/38 381/160 |

* cited by examiner

CONDENSER MICROPHONE UNIT AND CONDENSER MICROPHONE

BACKGROUND

Technical Field

The present invention relates to a condenser microphone unit and a condenser microphone.

Related Art

A condenser microphone unit includes a film-like diaphragm that vibrates upon receiving a sound wave, a fixed electrode (may also be referred to as "back plate") arranged to face the diaphragm with a predetermined gap, and another component that fixes and holds the diaphragm and the fixed electrode in a unit holder. In the condenser microphone unit having the structure, the diaphragm and the fixed electrode configure a capacitor, and when the diaphragm vibrates upon receiving a sound wave, capacitance of the capacitor is changed, and thus the change of the capacitance is output as change of an electrical signal.

In the condenser microphone unit, when the diaphragm, the fixed electrode, and the other component are not positioned in the unit holder with accuracy, an individual difference in characteristics of the microphone occurs due to eccentricity between components, further leading to breakdown.

In the condenser microphone unit, a baffle is used as a unit holder that fixes a microphone element to achieve improvement of sensitivity. In this case, fixation of components, and not causing the eccentricity between the components are desired in assembly.

Japanese Patent No. 4926663 describes a condenser microphone in which a baffle is mounted, and which decreases vibration and noises while enhancing sensitivity. However, the condenser microphone of Japanese Patent No. 4926663 does not teach a configuration to accurately arrange the configuration components of the microphone unit in the baffle.

SUMMARY

An objective of the present invention is to provide a condenser microphone unit that prevents eccentricity as much as possible and achieves improvement of assembly accuracy, and a condenser microphone using the condenser microphone unit.

A condenser microphone unit according to the present invention is a condenser microphone unit including a diaphragm that vibrates upon receiving a sound wave and made of a plurality of configuration components that are assembled, and the condenser microphone unit includes: a base member including an opening portion to which the plurality of configuration components are attached; and an adjustment member having an outer diameter corresponding to a diameter of the opening portion, and mounted to surround a side surface of one or more components accommodated in the opening portion, of the plurality of configuration components, wherein the adjustment member is a frame body exhibiting an annular shape and including a notch portion notched to have a pair of end portions, and is fixed in the opening portion in a state of being mounted to the side surface of the one or more components.

According to the condenser microphone unit of the present invention, the eccentricity is effectively suppressed, and improvement of the assembly accuracy is achieved.

BRIEF DESCRIPTION OF DRAWINGS

FIG. 4A is a plan view of the diaphragm plate and FIG. 4B is an exploded view illustrating arrangement relationship between the diaphragm plate and the spacer in a back view and a side sectional view of the diaphragm plate and a plan view of the spacer;

FIG. 7A is a plan view and FIG. 7B is a partially notched perspective view;

FIG. 8A is an exploded side sectional view and FIG. 8B is a partial sectional view illustrating the adjustment member and the resistance plate holding member illustrated in FIG. 8A which are partially enlarged;

FIG. 11A is an exploded side sectional view and FIG. 11B is a partial sectional view illustrating the adjustment member, the baffle, and the components illustrated in FIG. 11A, which are partially enlarged.

DETAILED DESCRIPTION

Hereinafter, a condenser microphone according to an embodiment of the present invention will be described in detail with reference to the drawings.

Figure 1:
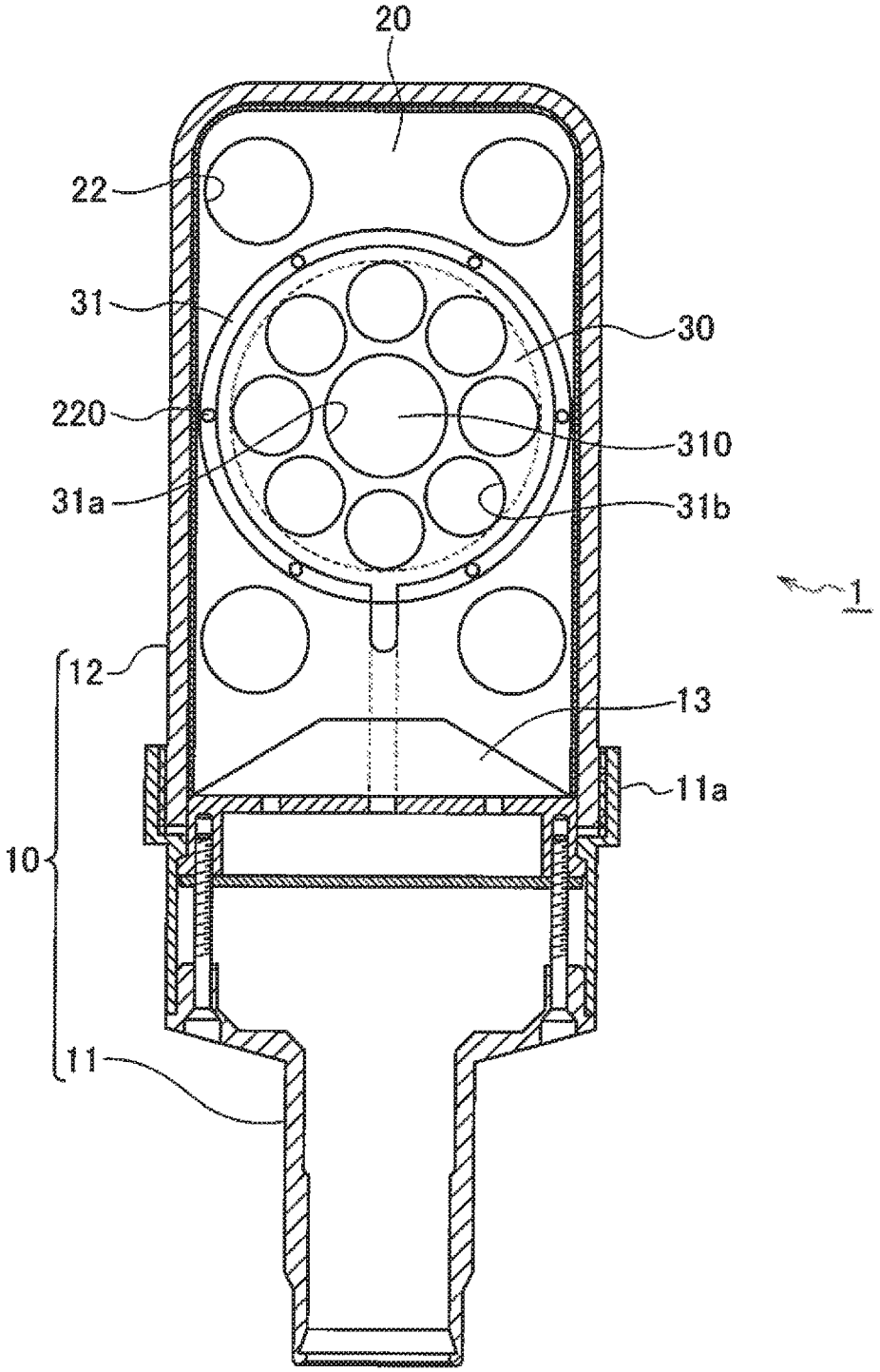
FIG. 1 is a vertical sectional view of a condenser microphone according to an embodiment of the present invention.
Figure 2:
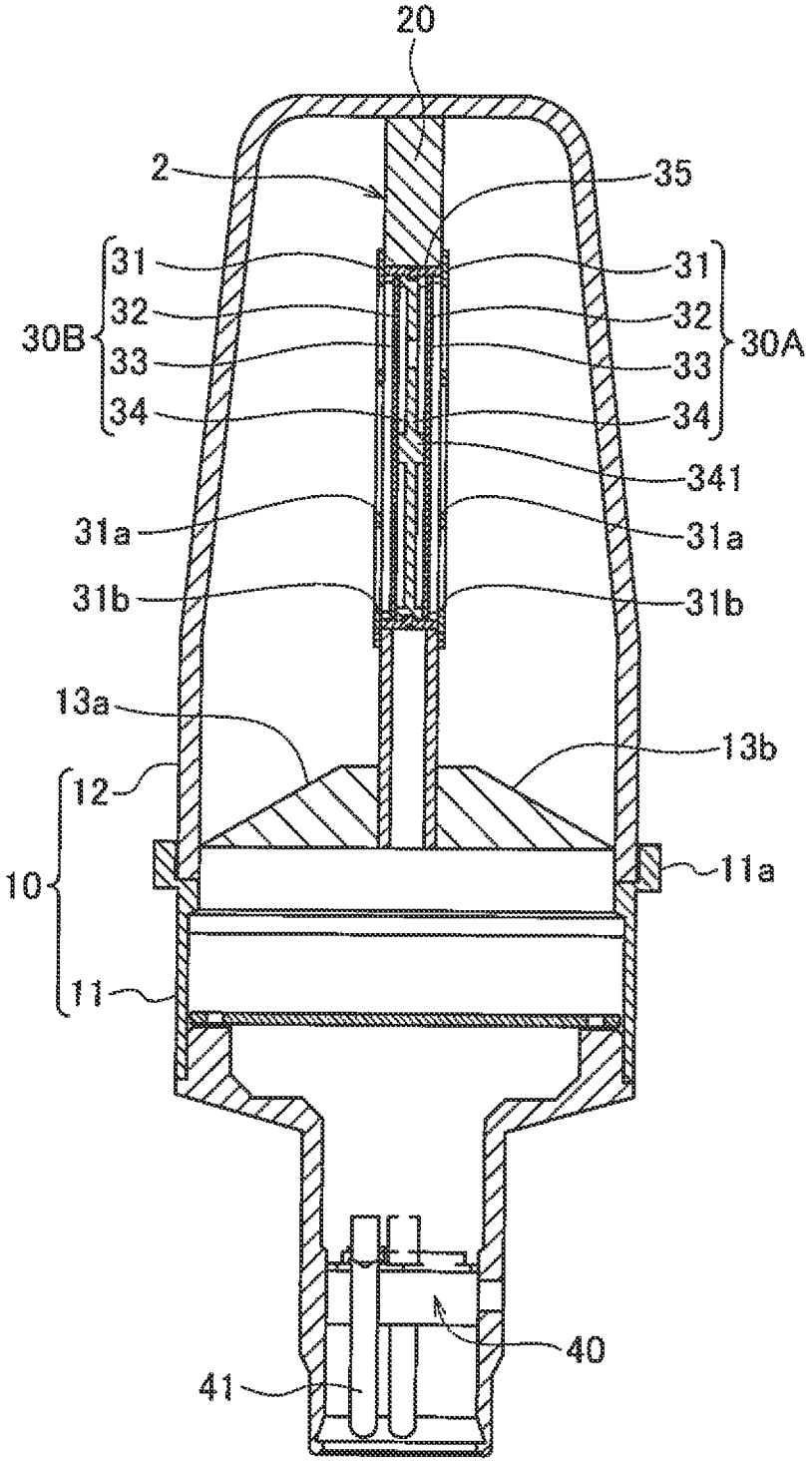
FIG. 2 is a side sectional view of the condenser microphone.

As illustrated in FIGS. 1 and 2, a condenser microphone 1 of an embodiment includes, as a housing 10, a lower case 11 to be attached to a microphone stand and an upper case 12 in which a microphone unit 2 is accommodated.

The upper case 12 has a cup-like external shape, and is attached to the lower case 11 to be sandwiched between a base portion 13 provided at one end side (an upper side in FIG. 1) of the lower case 11 and a latch portion 11*a* formed into a ring shape on a side surface of the lower case 11. A connector base 40 to which a plurality of connector pins 41 is attached is arranged at the other end side (a lower side in FIG. 2) of the lower case 11. One end side of the connector pin 41 is connected to a signal line from a microphone element 30. The other end side of the connector pin 41 is connected with an external device, so that an output signal of the microphone unit 2 is supplied to the external device.

The microphone unit 2 includes a baffle 20 as a base member, and the microphone element 30 made of a plurality of components to be attached to the baffle 20. Further, the microphone unit 2 includes an adjustment member 35 for performing positioning and position adjustment of the microphone element 30 with respect to the baffle 20.

In the microphone element 30, a pair of diaphragm plates 31 and 31, a pair of spacers 32 and 32, a pair of fixed electrodes 33 and 33, and a resistance plate holding member 34 are arranged from an outside. The microphone element 30 has a configuration in which a pair of microphone elements 30A and 30B is arranged, sharing the resistance plate holding member 34. That is, the microphone unit 2 of the present embodiment is a bi-directional microphone unit in which the pair of condenser microphone elements 30A and 30B is arranged back to back. Hereinafter, these units will be described in detail with reference to FIGS. 3A to 3C and the subsequent drawings. Note that, in the present embodiment, the above-described members in pairs have the same configurations, and thus only one member will be described.

(Configuration of Baffle)

Figure 3A:
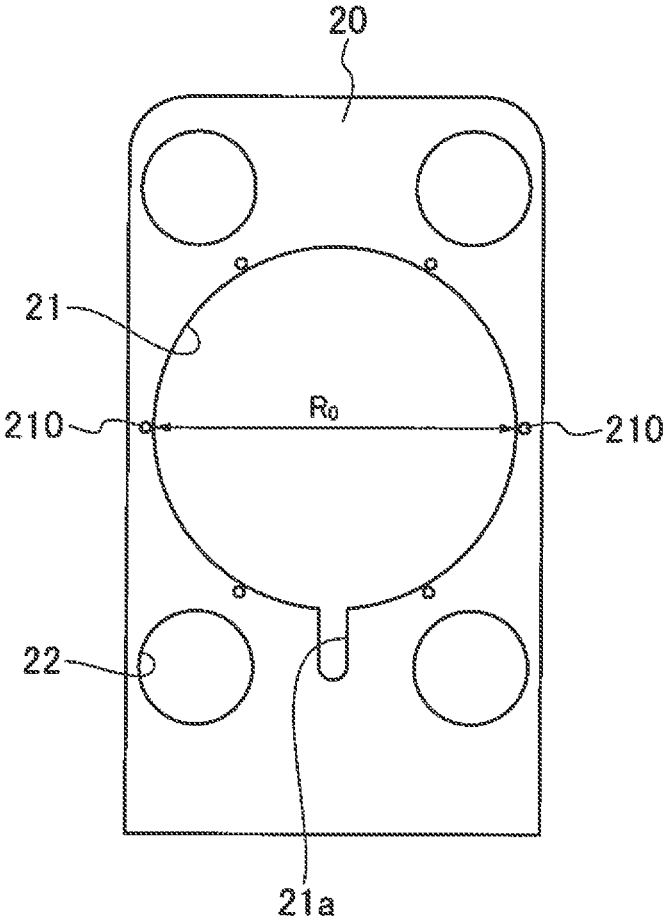
FIG. 3A is a front view illustrating a baffle of the condenser microphone.

First, a configuration of the baffle 20 will be described with reference to FIGS. 3A to 3C. As illustrated in FIG. 3A, the baffle 20 has an approximately square external shape in plan view. An approximately circular opening portion 21 for attaching the microphone element 30 and the adjustment member 35 is formed in the center of the baffle 20. In the opening portion 21, a notch portion 21*a* communicating with a long hole 213 described below is formed to extend from the circular shape. A plurality of (six in this example) screw holes 210 for attaching the diaphragm plates 31 is provided in a periphery of the opening portion 21. Further, a plurality of (four in this example) circular opening portions 22 with a smaller diameter than the opening portion 21 is provided outside the screw holes 210.

FIG. 3A illustrates a front-side external shape of the baffle 20, and an opposite side, that is, a back side of the baffle 20 has a similar external shape. FIG. 3B illustrates a right-side side surface of the battle 20, and a left-side surface at the opposite side has also a similar external shape. As illustrated in FIGS. 3B and 3C, a plurality of (four in this example) screw holes 211 is formed in the right and left side surfaces of the baffle 20. The screw holes 211 play a role to fix the adjustment member 35 and the various components to the baffle 20 with screws 221 (see FIG. 9), and configure a fixing mechanism together with the screws 221. Details of the fixing mechanism and the adjustment member 35 will be described below.

Figure 3B:
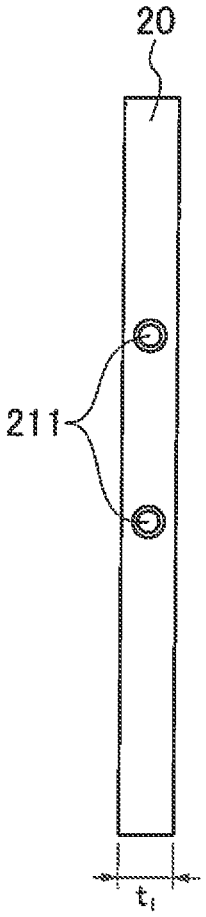
FIG. 3B is a side view of the baffle.
Figure 3C:
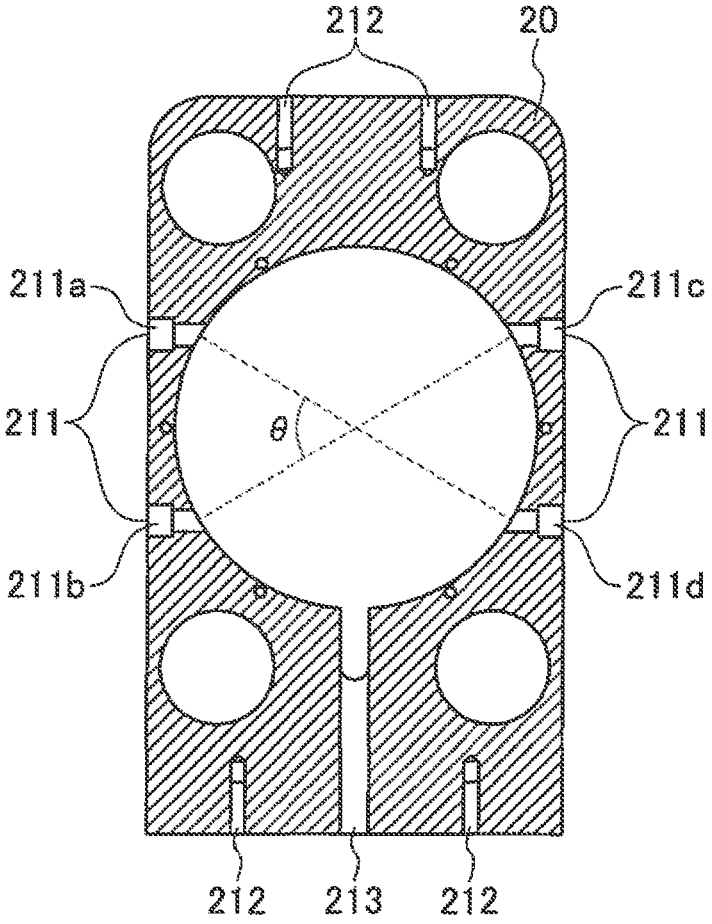
FIG. 3C is a front sectional view of the baffle.

As illustrated in FIG. 3C, a plurality of (four in this example) screw holes 212 for attaching the baffle 20 to the housing 10 is formed in upper and lower side surfaces of the baffle 20. Further, the long hole 213 for pulling out the signal line from the microphone element 30 is provided in a bottom surface of the baffle 20, that is, in a lower-side side surface. The long hole 213 is formed to communicate with the notch portion 21*a* of the opening portion 21 from the bottom surface of the baffle 20.

In the present embodiment, the baffle 20 is a hard insulating body made of a resin. A thickness $t_1$ of the member of the baffle 20 is set to a size considering thicknesses of the configuration components of the microphone element 30. To be specific, the thickness $t_1$ is set to a size with which the baffle 20 can accommodate all of the resistance plate holding member 34, the pair of fixed electrodes 33 and 33, and the pair of spacers 32 and 32, and can further accommodate a part of the diaphragm plates 31 and 31. A diameter $R_0$ of the opening portion 21 of the baffle 20 is set to a site considering diameters of the configuration components of the microphone element 30 and of the adjustment member 35.

(Configurations of Diaphragm Plate and Spacer)

Configurations of the diaphragm plate 31 and the spacer 32 will be described with reference to FIGS. 4A and 4B. Note that FIG. 4B illustrates an opposite-side surface of the diaphragm plate 31 illustrated in FIG. 4A, and illustrates a state in which the diaphragm 310 is detached.

Figure 4A:
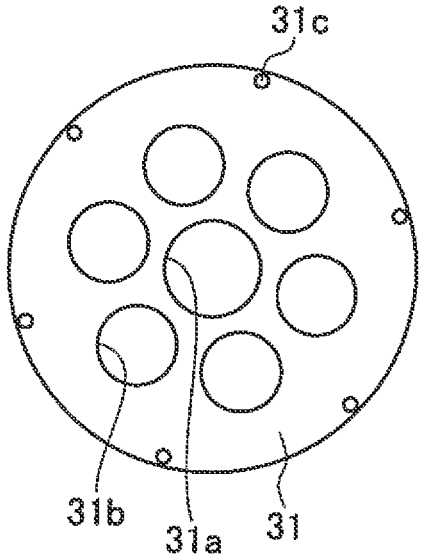
FIGS. 4A and 4B are diagrams illustrating a diaphragm plate and a spacer.

The diaphragm plate 31 is made of metal, and has a circular external shape in plan view, as illustrated in FIG. 4A. A circular first opening 31*a* is provided in the center of the diaphragm plate 31, and a plurality of (six in this example) circular second openings 31*b* with a smaller diameter than the first opening 31*a* is provided outside the first opening 31*a*. A plurality of (six in this example) holes 31*c* into which the screws are inserted is provided near a side surface of the diaphragm plate 31. The positions of the respective holes 31*c* correspond to the positions of the screw holes 210 of the baffle 20 described above.

Figure 4B:
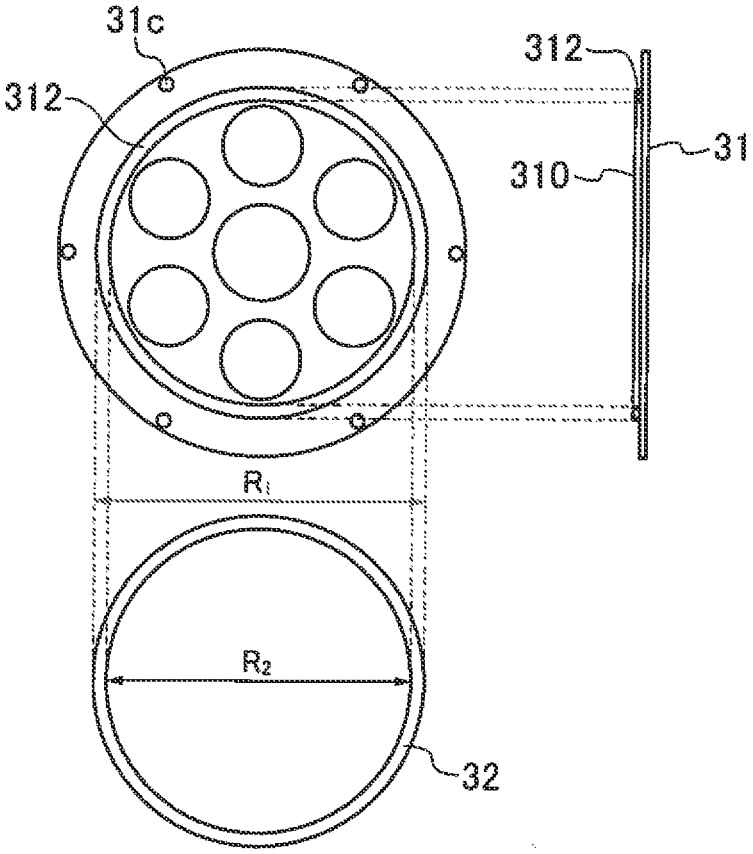

As illustrated in FIG. 4B, a ring-like rib 312 is provided on a back surface of the diaphragm plate 31, and the film-like diaphragm 310 is fixed to the rib 312. The rib 312 has a ring shape, and is arranged outside the second openings 31*b*. An outer diameter $R_1$ of the rib 312 is set to a size smaller than the diameter $R_0$ of the opening portion 21 of the baffle 20 (that is, $R_1<R_0$). The diaphragm 310 is an extremely thin film material on which metal is deposited, exhibits a circular shape with an approximately the same diameter as the rib 312 of the diaphragm plate 31, and is fixed to the rib 312.

The spacer 32 is a member for securing vibration of the diaphragm 310 by providing a gap between the diaphragm 310 and the fixed electrode 33, and is formed into a ring shape corresponding to the shape of the rib 312, as illustrated in FIG. 4B. In this example, the spacer 32 is made of a resin, and an outer diameter $R_1$ and an inner diameter $R_2$ are set to sizes equal to those of the rib 312.

(Configuration of Fixed Electrode)

Figure 5:
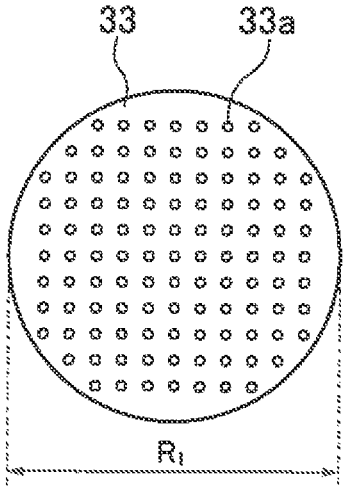
FIG. 5 is a plan view illustrating a configuration of a fixed electrode.

A configuration of the fixed electrode 33 will be described with reference to FIG. 5. The fixed electrode 33 is a thin plate-like member made of metal, and has a circular external shape in plan view, as illustrated in FIG. 5. The diameter of the fixed electrode 33 is set to the diameter $R_1$ that is equal to the outer diameters of the rib 312 and the spacer 32 described above. A plurality of holes 33*a* with a small diameter, which functions as a distribution passage of the air, is formed in the fixed electrode 33. The fixed electrode 33 configures a capacitor between the fixed electrode 33 and the diaphragm 310 by being arranged to face the diaphragm 310 with a predetermined interval.

(Configurations of Resistance Plate Holding Member and Resistance Plate)

Figure 6A:
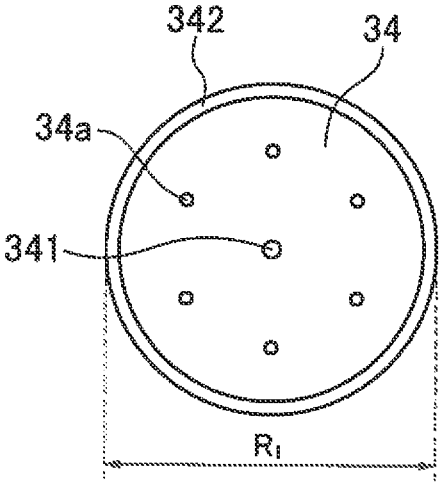
FIG. 6A is a plan view of a resistance plate holding member.
Figure 6B:
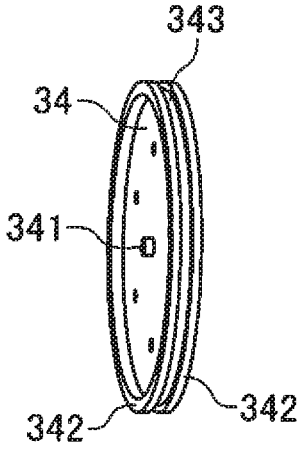
FIG. 6B is a perspective view of the resistance plate holding member.

A configuration of the resistance plate holding member 34 will be described with reference to FIGS. 6A to 6C. The resistance plate holding member 34 is a member made of metal, and has a circular external shape in plan view, as illustrated in FIG. 6A. A circular shaft 341 is provided in the center of the resistance plate holding member 34, and a plurality of (six in this example) circular holes 34*a* with a relatively small diameter, which functions as a distribution passage of the air, is provided outside the shaft 341. The diameter of the hole 34*a* is larger than the hole 33*a* of the fixed electrode 33, and is smaller than the second opening 31*b* of the diaphragm plate 31. FIG. 6A illustrates a one-side surface of the resistance plate holding member 34, and an opposite-side surface has also the same shape. As illustrated in FIGS. 6A and 6B, a pair of ribs 342 is provided on outer peripheries or the resistance plate holding member 34 in a flange manner, and a groove 343 is formed between the flange portions (ribs) 342 and 342.

Figure 6C:
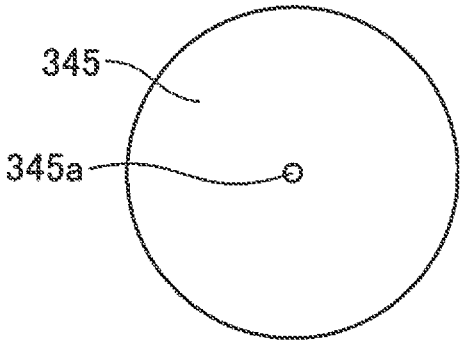
FIG. 6C is a plan view of a resistance plate to be attached to the resistance plate holding member.

Although illustration is omitted in other drawings, an appropriate number of resistance plates 345 as illustrated in FIG. 6C is attached to the resistance plate holding member 34. The resistance plate 345 is a member that plays a role of acoustic resistance, and exhibits a planar circular thin plate shape. The resistance plate 345 is made of an insulating body such as sponge or a resin, and a circular hole 345*a* to be inserted onto the shaft 341 of the resistance plate holding member 34 is formed in the center. The diameter of the resistance plate 345 is smaller than the diameter $R_1$ of the resistance plate holding member 34, and is approximately equal to the inner diameter of the rib 342 of the resistance plate holding member 34. The resistance plates 345 can be attached to be accommodated in the ribs 342 of the resistance plate holding member 34 by the number not exceeding the thickness of the resistance plate holding member 34.

(Configuration of Adjustment Member)

Next, a configuration of the adjustment member 35 will be described with reference to FIGS. 7A and 7B. FIG. 7B illustrates the adjustment member 35 with a notched one end side, for clarifying a section shape.

Figure 7A:
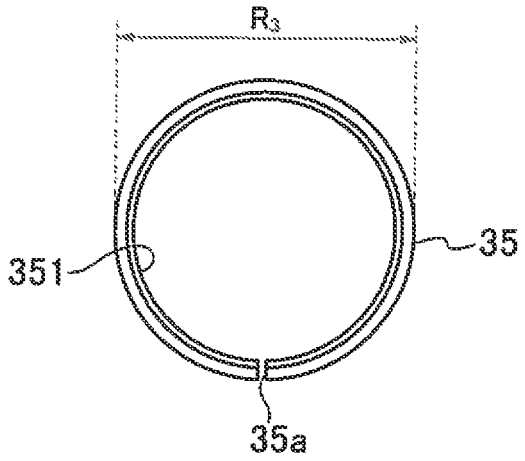
FIGS. 7A and 7B are external views illustrating a configuration of an adjustment member.
Figure 7B:
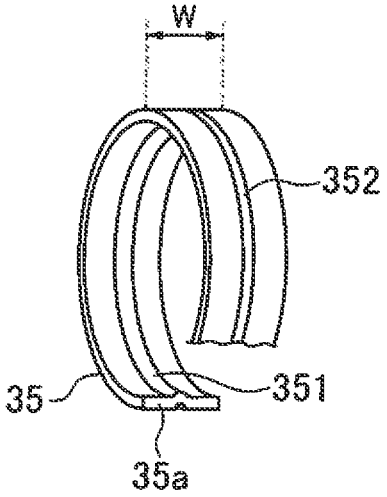

As illustrated in FIG. 7A, the adjustment member 35 is a C ring-shaped member (frame body) exhibiting an annular shape, and including a notch portion 35*a* notched to have a pair of end portions. The adjustment member 35 is set to have a size corresponding to the diameter $R_0$ of the opening portion 21 of the baffle 20. To be specific, an outer diameter $R_3$ of the adjustment member 35 in a state where the notch portion 35*a* is closed, that is, in a state where the pair of end portions comes in contact with each other is smaller than the diameter $R_0$ of the opening portion 21 of the baffle 20. Then, the adjustment member 35 becomes to have an outer diameter equal to the diameter $R_0$ of the opening portion 21 when the notch portion 35*a* is opened, that is, when the pair of end portions is separated and the adjustment member 35 becomes the "C" shape.

As illustrated in FIG. 7B, a width W of the adjustment member 35 is set to a size considering the thicknesses of the configuration components of the microphone element 30. In this example, the width W of the adjustment member 35 is approximately equal to the thickness $t_1$ of the member of the baffle 20 described above.

A rib-like protruding portion 351 is provided on and along an inner peripheral surface of the adjustment member 35 in a center of a width direction. A groove-like recessed portion 352 corresponding to the protruding portion 351 is provided in and along an outer peripheral surface of the adjustment member 35 in the center in the width direction.

In this example, the adjustment member 35 is made of a resin, and can also be formed of metal as another example.

(Assembly of Configuration Components)

Next, a procedure and the like in a case of attaching the configuration components of the microphone element 30 to the baffle 20 and assembling the microphone unit 2 will be described mainly with reference to FIGS. 8A and 8B and subsequent drawings.

Figure 8A:
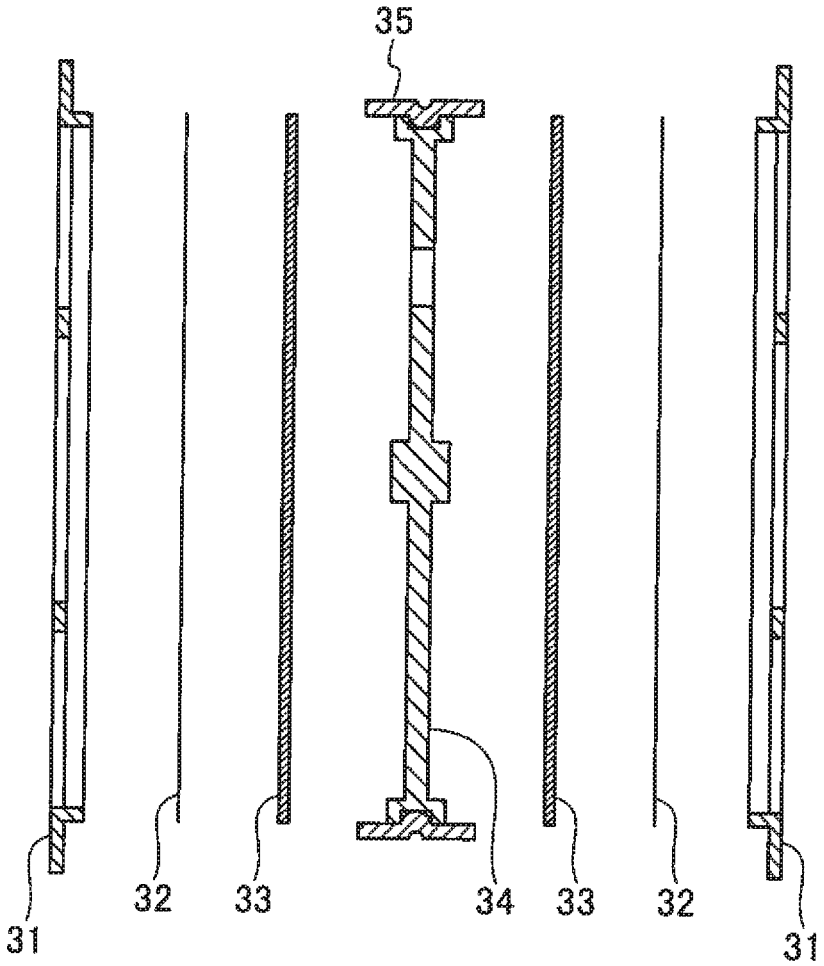
FIGS. 8A and 8B are diagrams for describing a procedure to attach components to the adjustment member.
Figure 8B:
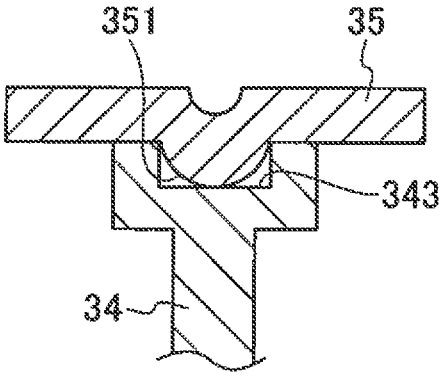

First, as illustrated in FIG. 8A, the adjustment member 35 is enlarged in its radial direction and is brought to cover a side surface of the resistance plate holding member 34, thereby to be mounted to surround the side surface of the resistance plate holding member 34. At this time, as illustrated in FIG. 8B, the protruding portion 351 of the adjustment member 35 is fit into the groove 343 in the side surface of the resistance plate holding member 34. The resistance plates 345 are appropriately attached to the resistance plate holding member 34. The adjustment member 35 is attached to the opening portion 21 of the baffle 20 at an appropriate time after the resistance plate holding member 34 is attached as described above.

Figure 9:
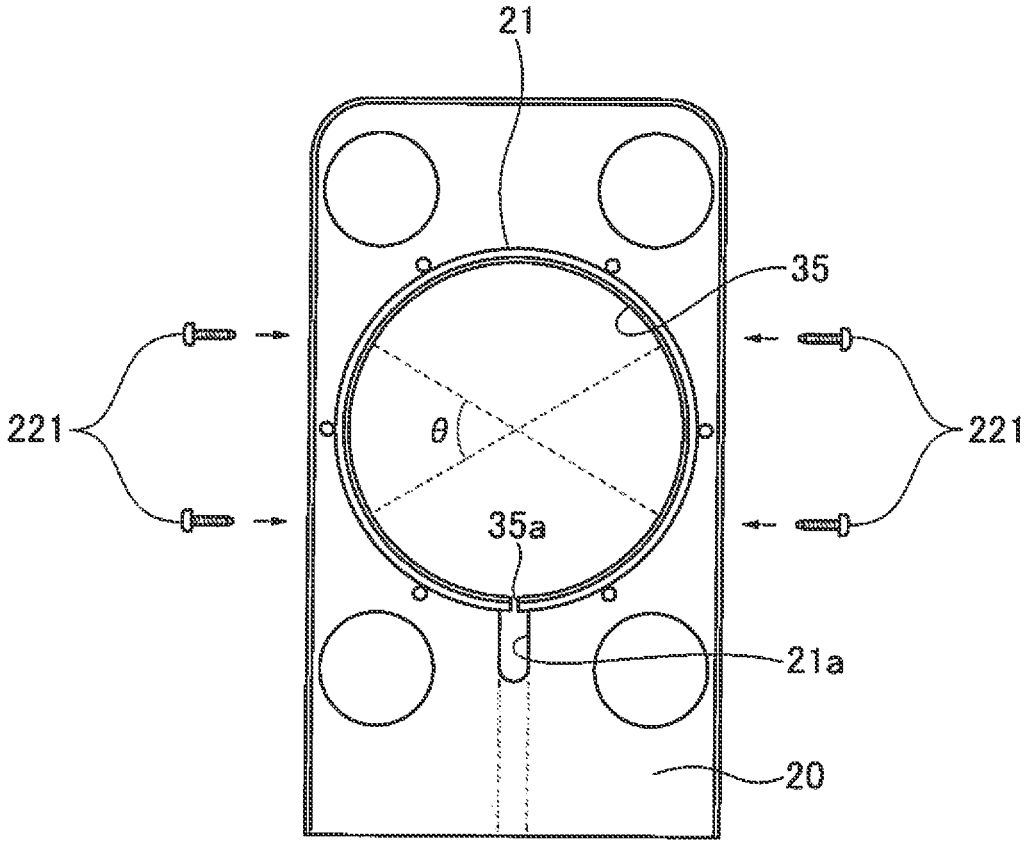
FIG. 9 is diagram for describing a procedure to fix the adjustment member and the components to the baffle.

A procedure to attach the adjustment member 35 to the opening portion 21 will be described with reference to FIGS. 9 and 10. Note that, in FIG. 9, for clarification and simplification, illustration of the configuration components such as the resistance plate holding member 34 is omitted. In attaching the adjustment member 35 to the opening portion 21, it is good to position the notch portion 35*a* of the adjustment member 35 to the notch portion 21*a* of the opening portion 21, as illustrated in FIG. 9. With such arrangement, the adjustment member 35 effectively functions in fixing the adjustment member 35, and the gap of the notch portion 35*a* of the adjustment member 35 can be used in pulling out a component such as wiring from the microphone element 30.

In addition, as illustrated in FIGS. 3B and 3C, and FIG. 9, in the present embodiment, the four screw holes 211 (211*a* to 211*d*) of the baffle 20 are provided in symmetrical positions. Further, an intersection angle θ at which two virtual lines intersect, when the virtual lines are respectively drawn between the screw holes 211*a* and 211*d*, and between the screw holes 211*c* and 211*b*, is set to about 45 degrees. With such a configuration, the positions of the adjustment member 35 and the configuration components with respect to the opening portion 21 of the baffle 20 can be finely adjusted in an up and down direction and in a right and left direction.

The screws 221 are screwed into the respective screw holes 211 (211*a* to 211*d*) of the baffle 20 in the state where the adjustment member 35 is attached to the opening portion 21 as described above. At this time, as illustrated in FIG. 10, a tip end portion of one screw 221 is fitted into the recessed portion 352 of the adjustment member 35, so that movement of the adjustment member 35 in the width (the arrow W) direction is regulated or prohibited. Further, when the respective screws 221 are screwed, the adjustment member 35 is biased in the radial direction by the screws 221 and is contracted to reduce the diameter. With this operation, an inner surface of the adjustment member 35 is pressed against side surfaces of the accommodated configuration components, and the adjustment member 35 is fixed to the opening portion 21 and fixes the positions of the configuration components. At this time, the diameter of the adjustment member 35 is reduced, and the position of the adjustment member 35 with respect to the opening portion 21 is moved. Therefore, by adjusting the degrees of screwing of the four screws 221, the adjustment member 35 and the accommodated configuration components can be fixed to desired positions.

Hereinafter, a case of accommodating the adjustment member 35 to which the resistance plate holding member 34 is attached to the opening portion 21 of the baffle 20, and then attaching other configuration components into the opening portion 21 and the adjustment member 35 will be described.

Figure 11A:
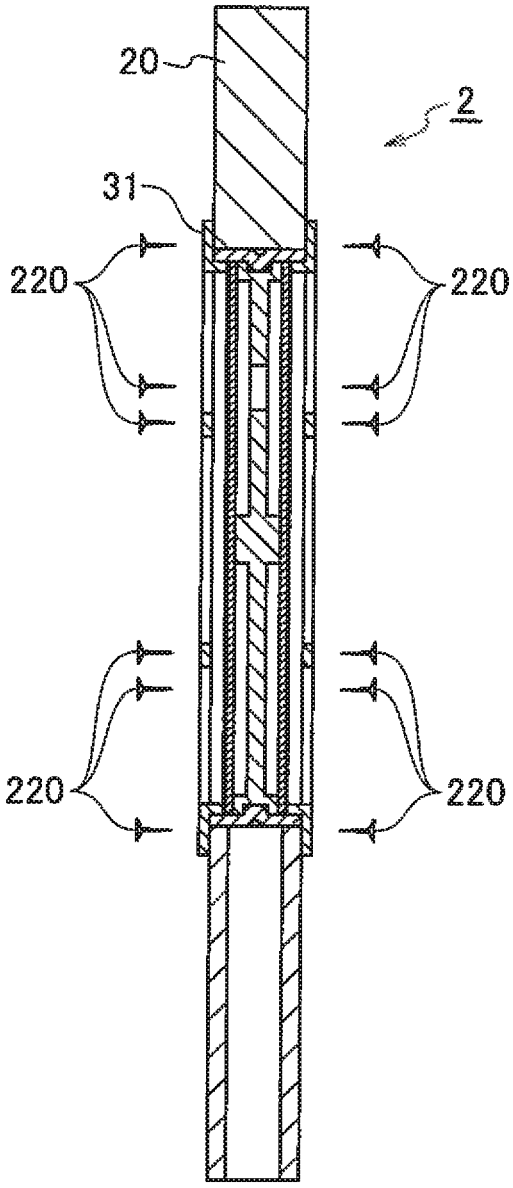
FIGS. 11A and 11B are diagrams illustrating a state in which the components and the adjustment member are attached to the baffle.
Figure 11B:
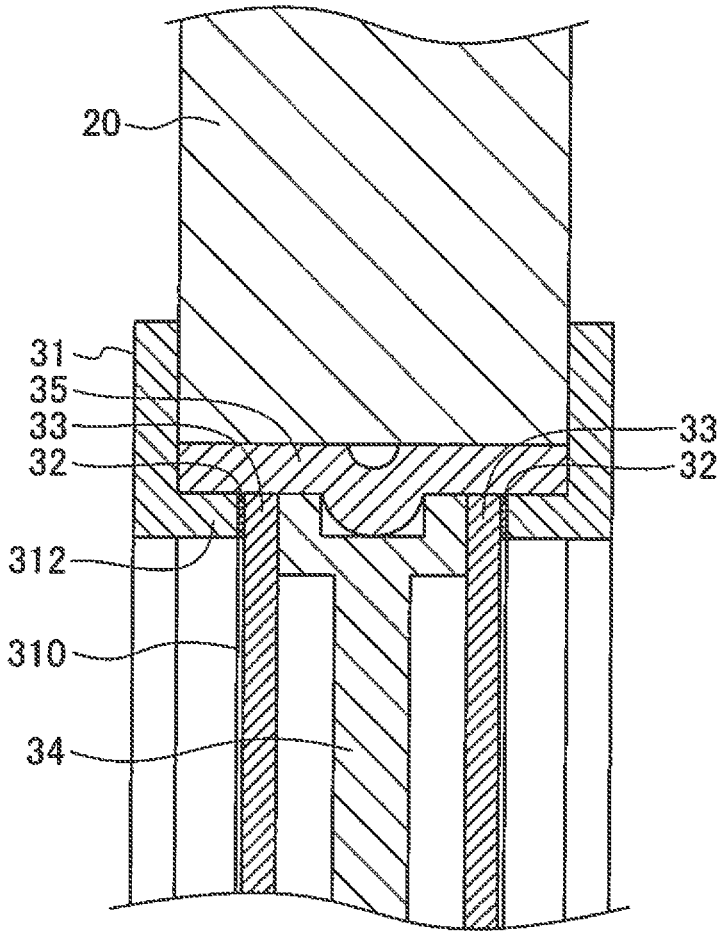

In the state where the adjustment member 35 and the resistance plate holding member 34 are accommodated in the opening portion 21 of the baffle 20, the fixed electrodes 33 and 33 are attached to the both sides of the resistance plate holding member 34. At this time, the fixed electrodes 33 are accommodated inside the opening portion 21 and the adjustment member 35, and edge portions near side surfaces of the fixed electrodes 33 come close to or come in contact with the ribs 342 of the resistance plate holding member 34 (see FIG. 11B). Following that, the spacers 32 and 32 are respectively attached to both sides of the fixed electrodes 33 and 33. At this time, the spacers 32 are accommodated inside the adjustment member 35, and one-side surfaces of the spacers 32 come close to or come in contact with the fixed electrodes 33 (see FIG. 11B). Next, the diaphragm plates 31 and 31 are attached to the opening portion 21 and the adjustment member 35. The diaphragm plates 31 are attached to the opening portion 21 such that the positions of the respective holes 31*c* are matched with the positions of the corresponding screw holes 210 of the baffle 20, and are attached to the opening portion 21, using the plurality of (six, respectively, in this example) screws 220, as illustrated in FIG. 11A. At this time, the ribs 312 of the diaphragm plates 31 are accommodated inside the adjustment member 35, and edge portions of the diaphragms 310 come close to or come in contact with the spacers 32 (see FIG. 11B).

Therefore, when the configuration components are attached to the opening portion 21 and the adjustment member 35, the adjustment member 35 is fastened with the screws 221 as described above, thereby to bias the accommodated configuration components with the inner surface. By such a method, the adjustment member 35 is fixed to the opening portion 21 of the baffle 20, and fixes the positions of the configuration components with respect to the opening portion 21.

Therefore, according to the microphone unit 2 of the present embodiment, eccentricity between the components is prevented and improvement of assembly accuracy and a yield can be achieved in assembly.

Figure 10:
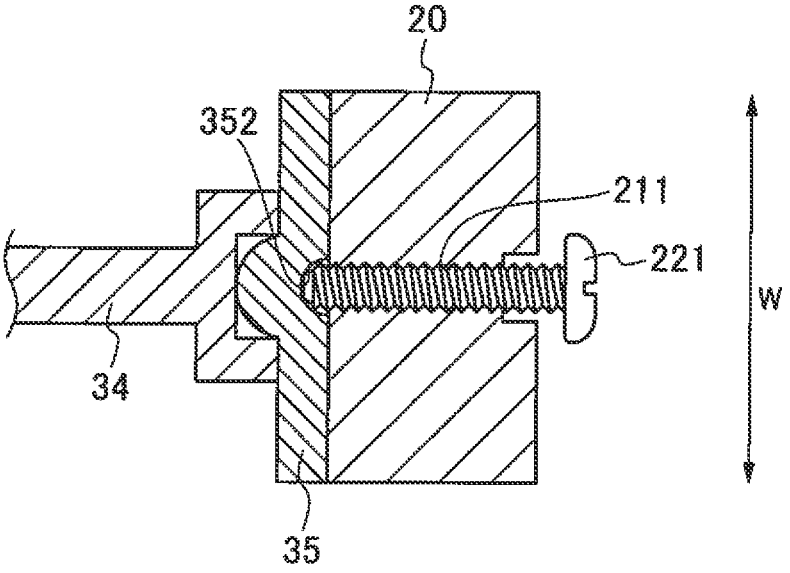
FIG. 10 is an enlarged sectional view for describing a state in which the adjustment member and the components are fixed to the baffle.

Further, the present embodiment has the configuration in which the adjustment member 35 is fastened using the four screws 221 from the four directions, as illustrated in FIG. 10. Therefore, the positions of the configuration components can be finely adjusted by individually adjusting screwing of the screws 221. With such fine adjustment, occurrence of an individual difference in characteristics of the condenser microphone 1 can be further prevented.

The microphone unit 2 in which the positions of the configuration components are adjusted is attached such that the lower side of the baffle 20 is attached between a pair of base portions 13*a* and 13*b* of the lower case 11, as illustrated in FIG. 2. Then, the screws are screwed into the screw holes 212 (see FIG. 3C) in the bottom surface of the baffle 20, so that the microphone unit 2 is fixed to the lower case 11. Following that, the upper case 12 is mounted to the lower case 11, so that the microphone unit 2 is accommodated in the housing 10. Then, the screws are screwed into the screw holes 212 (see FIG. 3C) in an upper surface of the baffle 20, so that the microphone unit 2 is fixed to the upper case 12.

In the microphone unit 2 and the condenser microphone 1 assembled as described above, the diaphragm 310 and the fixed electrode 33 configure the capacitor, and when the diaphragm 310 vibrates upon receiving a sound wave, the capacitance of the capacitor is changed, and change of the capacitance is output as change of an electrical signal. In the microphone unit 2 and the condenser microphone 1 in which positioning between the components is accurately performed, an output signal, is normally output in outputting the signal, and an individual difference in the output signal between microphones is less likely to occur.

Further, in the present embodiment, the adjustment member 35 as a frame body is mounted to surround the side surfaces of the configuration components, and the adjustment member 35 is firmly fixed to the baffle 20 of the base member. Therefore, durability is secured, and positional deviation and eccentricity between the components are less likely to occur for a long period of time.

According to the above-described embodiment, a condenser microphone unit and a condenser microphone in which the eccentricity is effectively suppressed and which achieve improvement of the assembly accuracy can be provided.

The above-described embodiment is an example, and carious modifications and changes as exemplified below are possible.

In the present embodiment, the configuration provided with the four screw holes 211 and the four screws 221 has been described as the fixing mechanism. The configuration numbers of the screw holes 211 and the screws 221 in the fixing mechanism are not limited thereto and can be three or less, or five or more.

In the present embodiment, the microphone unit 2 having the structure in which the pair of microphone elements 30A and 30B is arranged back to back, and the pair of microphone elements 30A and 30B shares the resistance plate holding member 34 has been described. As another example, a microphone unit provided with one microphone element may be employed.

In the present embodiment, the example in which the resistance plate holding member 34, the fixed electrodes 33, and the spacers 32 are accommodated in the adjustment member 35, and a part including the diaphragms 310 of the diaphragm plates 31 is accommodated in the adjustment member 35, of the components that configure the microphone element 30 (30A and 30B), has been described. Various design changes of the configuration can be made. For example, the diaphragm plate 31 may be configured such that the entire member is accommodated in the adjustment member 35, similar to other configuration components, instead of the above-described configuration in which the diaphragm plate 31 is fixed to the baffle 20 with the screws 220. Alternatively, the diaphragm plate 31 may not be accommodated in the adjustment member 35 while being fixed to the baffle 20 with the screws 220.

In the present embodiment, the case in which the shape of the opening portion 21 of the baffle 20 in plan view is an approximately circular shape, and the external shapes of the configuration members are circular shapes has been described. The shapes and the external shapes can be deformed to various shapes such as a polygon. In this case, the adjustment member 35 may just be a frame body including a notch portion and having a polygonal external shape.

In addition, design change of the condenser microphone unit and the condenser microphone of the present invention can be made without departing from the technical idea described in claims.

What is claimed is:

1. A condenser microphone unit including a diaphragm that vibrates upon receiving a sound wave and made of a plurality of configuration components of the condenser microphone unit that are assembled together, the condenser microphone unit comprising:

a base member including an opening portion to which the plurality of configuration components of the condenser microphone unit are attached; and an adjustment member having an outer diameter corresponding to a diameter of the opening portion in the base member, and mounted to surround a side surface of one or more components of the plurality of configuration components of the condenser microphone unit accommodated in the opening portion in the base member, wherein the adjustment member has an annular shape and includes a notch portion notched to have a pair of end portions, and is fixed in the opening portion in the base member, and is mounted to the side surface of the one or more components, wherein the base member includes a fixing mechanism that biases the adjustment member to be contracted in a radial direction, and fixes, in the opening portion in the base member, the adjustment member and the one or more components accommodated in the adjustment member, wherein the fixing mechanism includes a screw hole formed in the base member, and a screw to be screwed into the screw hole, and the screw hole communicates with the opening portion from a side surface of the base member, wherein the fixing mechanism is made of a plurality of the screw holes and the screws, and wherein the adjustment member includes a recessed portion into which a tip end portion of the screw is fitted.

2. The condenser microphone unit according to claim 1, wherein a notch portion is formed in the opening portion, and the notch portion of the adjustment member is attached in alignment with the notch portion of the opening portion.

3. The condenser microphone unit according to claim 1, wherein the plurality of configuration components of the condenser microphone unit includes a diaphragm plate including the diaphragm, a fixed electrode that configures a capacitor between the fixed electrode and the diaphragm, a spacer lying between the diaphragm plate and the fixed electrode, and a resistance plate holding member to which a resistance plate which provides acoustic resistance is attached, all of the resistance plate holding member, the fixed electrode, and the spacer are accommodated in the opening portion, and a part of the diaphragm plate, including the diaphragm, is accommodated in the opening portion.

4. The condenser microphone unit according to claim 3, wherein the adjustment member accommodates all of the resistance plate holding member, the fixed electrode, and the spacer, and the part of the diaphragm plate, including the diaphragm.

5. The condenser microphone unit according to claim 3, wherein a groove is provided in a side surface of the resistance plate holding member, and a protruding portion having a shape corresponding to the groove of the resistance plate holding member is provided on an inner surface of the adjustment member.

6. The condenser microphone unit according to claim 5, wherein the protruding portion is provided in a center of the adjustment member in a width direction, a pair of the fixed electrodes, a pair of the spacers, and a pair of the diaphragm plates are arranged in this order on both sides of the resistance plate holding member, and the inner surface of the adjustment member comes in contact with respective side surfaces of the resistance plate holding member, the fixed electrodes, and the spacers, and comes in contact with side surfaces of portions of the diaphragm plates, the side surfaces of portions of the diaphragm plates being accommodated in the opening portion.

7. The condenser microphone unit according to claim 1, wherein the opening portion of the base member has an approximately circular opening shape, and the adjustment member is a C ring-shaped member.

8. A condenser microphone made by incorporating a condenser microphone unit in a housing, the condenser microphone unit being a condenser microphone unit including a diaphragm that vibrates upon receiving a sound wave and made of a plurality of configuration components of the condenser microphone unit that are assembled together, and including a base member including an opening portion to which the plurality of configuration components of the condenser microphone unit is attached, and an adjustment member having an outer diameter corresponding to a diameter of the opening portion in the base member, and mounted to surround a side surface of one or more components of the plurality of configuration components of the condenser microphone unit accommodated in the opening portion in the base member, wherein the adjustment member has an annular shape and includes a notch portion notched to have a pair of end portions, and is fixed in the opening portion in the base member, and is mounted to the side surface of the one or more components, wherein the base member includes a fixing mechanism that biases the adjustment member to be contracted in a radial direction, and fixes, in the opening portion in the base member, the adjustment member and the one or more components accommodated in the adjustment member, wherein the fixing mechanism includes a screw hole formed in the base member, and a screw to be screwed into the screw hole, and the screw hole communicates with the opening portion from a side surface of the base member, wherein the fixing mechanism is made of a plurality of the screw holes and the screws, and wherein the adjustment member includes a recessed portion into which a tip end portion of the screw is fitted.

* * * * *